US011898754B2

(12) United States Patent
Kim

(10) Patent No.: US 11,898,754 B2
(45) Date of Patent: Feb. 13, 2024

(54) COMBUSTOR NOZZLE, COMBUSTOR, AND GAS TURBINE INCLUDING THE SAME

(71) Applicant: DOOSAN ENERBILITY CO., LTD, Changwon-si (KR)

(72) Inventor: Ho Keun Kim, Daejeon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 34 days.

(21) Appl. No.: 17/704,008

(22) Filed: Mar. 25, 2022

(65) Prior Publication Data

US 2023/0213195 A1 Jul. 6, 2023

(30) Foreign Application Priority Data

Jan. 6, 2022 (KR) ..... 10-2022-0001919

(51) Int. Cl.
*F23R 3/28* (2006.01)
*F23R 3/14* (2006.01)
*F23R 3/16* (2006.01)

(52) U.S. Cl.
CPC ..... *F23R 3/286* (2013.01); *F23R 3/14* (2013.01); *F23R 3/16* (2013.01)

(58) Field of Classification Search
CPC ..... F23R 3/14; F23R 3/16; F23R 3/286
See application file for complete search history.

(56) References Cited

U.S. PATENT DOCUMENTS 5,307,634 A 5/1994 Hu
8,197,249 B1 * 6/2012 Nguyen ..... F23D 14/76 60/737
2003/0167771 A1 * 9/2003 Hayashi ..... F23R 3/14 60/737
2003/0172655 A1 * 9/2003 Verdouw ..... F23D 14/82 60/737
2011/0083439 A1 4/2011 Zuo
2012/0291446 A1 11/2012 Hirata
2018/0128491 A1 5/2018 Boardman
2018/0363551 A1 12/2018 Chila
(Continued)

FOREIGN PATENT DOCUMENTS

CN 103998867 A 8/2014
CN 109654537 A 4/2019
(Continued)

OTHER PUBLICATIONS

The EESR dated Sep. 29, 2022.
KR NOA, dated Sep. 18, 2023.

*Primary Examiner* — Arun Goyal
(74) *Attorney, Agent, or Firm* — Harvest IP Law, LLP

(57) ABSTRACT

A combustor nozzle using fuel containing hydrogen, a combustor and gas turbine including the same are provided. The nozzle for a combustor configured to burn fuel containing hydrogen includes a fuel supply duct including a plurality of injection tubes through which air and fuel flow and a fuel passage through which fuel flows, a plurality of swirlers formed on a side surface of each of the plurality of injection tubes to guide air outside the injection tube to be introduced thereinto for swirling, and a plurality of fuel inlet holes formed radially through the injection tube to communicate with the fuel passage and allow fuel to flow through the fuel passage to the injection tube.

18 Claims, 9 Drawing Sheets

(56) References Cited

U.S. PATENT DOCUMENTS

| | | | | |
|---|---|---|---|---|
| 2019/0107281 | A1* | 4/2019 | Cho | F23R 3/14 |
| 2019/0338664 | A1 | 11/2019 | Kozhevnikov | |
| 2019/0360697 | A1* | 11/2019 | Tada | F23D 14/62 |
| 2023/0130173 | A1* | 4/2023 | Versailles | F23R 3/14 60/737 |

FOREIGN PATENT DOCUMENTS

| | | | |
|---|---|---|---|
| EP | 2954260 | B1 | 8/2014 |
| JP | 09166326 | A | 6/1997 |
| JP | 2011-196681 | A | 10/2011 |
| KR | 100349570 | B1 | 11/2002 |
| KR | 10-2014-0090141 | A | 7/2014 |
| KR | 10-2019-0044944 | A | 5/2019 |
| KR | 10-2020-0004455 | A | 1/2020 |
| KR | 1020200027894 | A | 3/2020 |
| KR | 1020200038699 | A | 4/2020 |

* cited by examiner

COMBUSTOR NOZZLE, COMBUSTOR, AND GAS TURBINE INCLUDING THE SAME

CROSS-REFERENCE TO RELATED APPLICATION

This application claims priority to Korean Patent Application No. 10-2022-0001919, filed on Jan. 6, 2022, the disclosure of which is incorporated herein by reference in its entirety.

BACKGROUND

Technical Field

Apparatuses and methods consistent with exemplary embodiments relate to a combustor nozzle, a combustor, and a gas turbine including the same, and more particularly, to a combustor nozzle using fuel containing hydrogen, a combustor, and a gas turbine including the same.

Description of the Related Art

A gas turbine is a power engine that mixes air compressed by a compressor with fuel for combustion and rotates a turbine with a high-temperature gas produced by the combustion. The gas turbine is used to drive a generator, an aircraft, a ship, a train, or the like.

The gas turbine includes a compressor, a combustor, and a turbine. The compressor sucks and compresses outside air, and transmits the compressed air to the combustor. The air compressed by the compressor is in a high-pressure and high-temperature state. The combustor mixes the compressed air compressed by the compressor with fuel and burns a mixture to produce combustion gas which is discharged to the turbine. Turbine blades in the turbine are rotated by the combustion gas to generate power. The generated power is used in various fields such as generating electric power and actuating machines.

Fuel is injected through nozzles installed in each combustor section of the combustor, and the nozzles enable injection of gas fuel and liquid fuel. Recently, it is recommended to use hydrogen fuel or fuel containing hydrogen to suppress carbon dioxide emission.

However, because hydrogen has a high combustion rate, when hydrogen fuel or fuel containing hydrogen is burned in a gas turbine combustor, the flame formed in the gas turbine combustor approaches the structure of the gas turbine combustor and is heated, which may cause a problem in the reliability of the gas turbine combustor.

In order to solve this problem, Korean Patent Application Publication No. 10-2020-0027894 discloses a combustor nozzle having a fuel supply duct. However, in the nozzle having the fuel supply duct, it may be difficult to uniformly mix fuel and air because a swirler is not installed in the nozzle.

SUMMARY

Aspects of one or more exemplary embodiments provide a combustor nozzle capable of minimizing backfire and improving fuel-air mixing characteristics to reduce $NO_X$ emission and increase flame stability by swirlers and fuel inlet holes formed in each injection tube, a combustor, and a gas turbine including the same.

Additional aspects will be set forth in part in the description which follows and, in part, will become apparent from the description, or may be learned by practice of the exemplary embodiments.

According to an aspect of an exemplary embodiment, there is provided a nozzle for a combustor configured to burn fuel containing hydrogen including: a fuel supply duct including a plurality of injection tubes through which air and fuel flow and a fuel passage through which fuel flows, a plurality of swirlers formed on a side surface of each of the plurality of injection tubes to guide air outside the injection tube to be introduced thereinto for swirling, and a plurality of fuel inlet holes formed radially through the injection tube to communicate with the fuel passage and allow fuel to flow through the fuel passage to the injection tube.

The plurality of swirlers may be tube swirlers formed on the side surface of the injection tube to guide air to be introduced through the plurality of swirlers in a circumferential direction.

Each of the tube swirlers may include a swirl guide hole formed through the side surface of the injection tube at an angle of 80 to 180 degrees, and a swirl guide connected to the swirl guide hole so as to be coupled to one side of the swirl guide hole and gradually radially directed in the circumferential direction of the other side.

The tube swirler may be disposed between one end of the injection tube for introducing air and the fuel inlet holes.

The fuel inlet holes may be arranged between one end of the injection tube for introducing air and the tube swirlers.

The fuel supply duct may further include a plurality of diffusion nozzle tubes arranged between the injection tubes and having an end cap formed at each end, the end cap having a plurality of diffusion injection holes formed therein.

The plurality of diffusion injection holes of the diffusion nozzle tube may be formed through an edge of the end cap to be inclined outwardly.

The plurality of swirlers may be hole swirlers formed through the side surface of the injection tube to contact with an inner peripheral surface and configured to guide air introduced through the plurality of swirlers in a circumferential direction.

The fuel inlet holes may be formed radially through the side surface of the injection tube to communicate with the fuel passage and allow fuel to flow through the fuel passage to the injection tube. The fuel inlet holes may be arranged between one end of the injection tube for introducing air and the hole swirlers.

According to an aspect of another exemplary embodiment, there is provided a combustor including: a nozzle assembly having a plurality of nozzles configured to inject fuel and air, and a duct assembly coupled to one side of the nozzle assembly to burn a mixture of the fuel and the air and transmit combustion gas to a turbine. Each of the plurality of nozzles may include a fuel supply duct including a plurality of injection tubes through which air and fuel flow and a fuel passage through which fuel flows, a plurality of swirlers formed on a side surface of each of the plurality of injection tubes to guide air outside the injection tube to be introduced thereinto for swirling, and a plurality of fuel inlet holes formed radially through the injection tube to communicate with the fuel passage and allow fuel to flow through the fuel passage to the injection tube.

The plurality of swirlers may be tube swirlers formed on the side surface of the injection tube to guide the air introduced through the plurality of swirlers in a circumferential direction.

Each of the tube swirlers may include a swirl guide hole formed through the side surface of the injection tube at an angle of 80 to 180 degrees, and a swirl guide connected to the swirl guide hole so as to be coupled to one side of the swirl guide hole and gradually radially directed in the circumferential direction of the other side.

The tube swirler may be disposed between one end of the injection tube for introducing air and the fuel inlet holes.

The fuel inlet holes may be arranged between one end of the injection tube for introducing air and the tube swirlers.

The fuel supply duct may further include a plurality of diffusion nozzle tubes arranged between the injection tubes and having an end cap formed at each end, the end cap having a plurality of diffusion injection holes formed therein.

The plurality of diffusion injection holes of the diffusion nozzle tube may be formed through an edge of the end cap to be inclined outwardly.

The plurality of swirlers may be hole swirlers formed through the side surface of the injection tube to contact with an inner peripheral surface and configured to guide air introduced through the plurality of swirlers in a circumferential direction.

The fuel inlet holes may be formed radially through the side surface of the injection tube to communicate with the fuel passage and allow fuel to flow through the fuel passage to the injection tube. The fuel inlet holes may be arranged between one end of the injection tube for introducing air and the hole swirlers.

According to an aspect of another exemplary embodiment, there is provided a gas turbine including: a compressor configured to compress air introduced from an outside, a combustor configured to mix fuel with the air compressed by the compressor and combust a mixture of the fuel and air to produce combustion gas, and a turbine having a plurality of turbine blades rotated by combustion gas produced in the combustor. The combustor may include a nozzle assembly having a plurality of nozzles configured to inject the fuel and the air, and a duct assembly coupled to one side of the nozzle assembly to burn the mixture of the fuel and the air and transmit the combustion gas to the turbine. Each of the plurality of nozzles may include a fuel supply duct including a plurality of injection tubes through which air and fuel flow and a fuel passage through which fuel flows, a plurality of swirlers formed on a side surface of each of the plurality of injection tubes to guide air outside the injection tube to be introduced thereinto for swirling, and a plurality of fuel inlet holes formed radially through the injection tube to communicate with the fuel passage and allow fuel to flow through the fuel passage to the injection tube.

The plurality of swirlers may be tube swirlers formed on the side surface of the injection tube to guide the air introduced through the plurality of swirlers in a circumferential direction.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
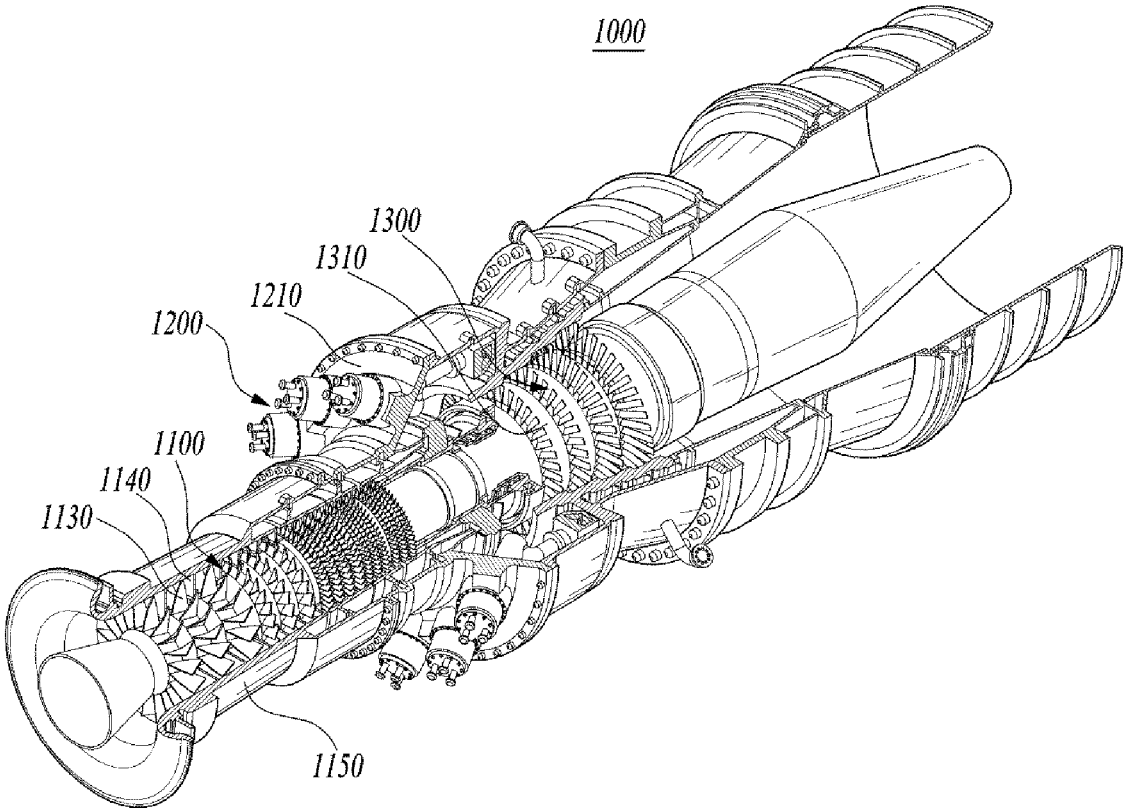
FIG. 1 is a view illustrating an interior of a gas turbine according to an exemplary embodiment.

Various modifications and different embodiments will be described below in detail with reference to the accompanying drawings so that those skilled in the art can easily carry out the disclosure. It should be understood, however, that the present disclosure is not intended to be limited to the specific embodiments, but the present disclosure includes all modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Hereinafter, exemplary embodiments will be described below in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Figure 2:
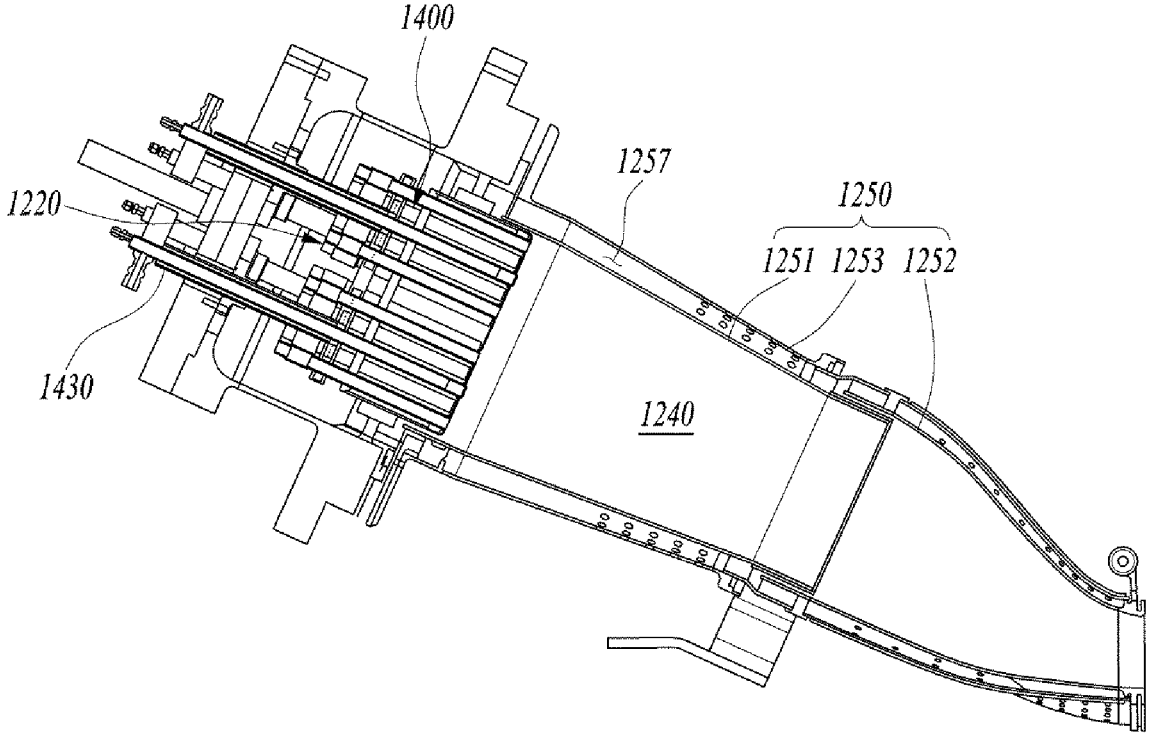
FIG. 2 is a view illustrating a combustor of FIG. 1.

FIG. 1 is a view illustrating an interior of a gas turbine according to an exemplary embodiment. FIG. 2 is a view illustrating a combustor of FIG. 1.

The thermodynamic cycle of the gas turbine may ideally comply with the Brayton cycle. The Brayton cycle consists of four phases including isentropic compression (i.e., an adiabatic compression), isobaric heat addition, isentropic expansion (i.e., an adiabatic expansion), and isobaric heat dissipation. In other words, in the Brayton cycle, thermal energy may be released by combustion of fuel in an isobaric environment after the atmospheric air is sucked and compressed to a high pressure, high-temperature combustion gas may be expanded and converted into kinetic energy, and exhaust gas with residual energy may be discharged to the atmosphere. As such, the Brayton cycle consists of four processes including compression, heating, expansion, and exhaust.

The gas turbine 1000 employing the Brayton cycle may include a compressor 1100, a combustor 1200, and a turbine 1300. Although the following description will be described with reference to FIG. 1, the present disclosure may be widely applied to other turbine engines having similar configurations to the gas turbine 1000 illustrated in FIG. 1.

Referring to FIG. 1, the compressor 1100 of the gas turbine 1000 may suck air from the outside and compress the air to supply air for combustion to the combustor 1200 and to supply the air for cooling to a high-temperature region of the gas turbine 1000 that is required to be cooled. In this case, because the air sucked into the compressor 1100 is subject to an adiabatic compression process therein, the pressure and temperature of the air passing through the compressor 1100 increases.

The compressor 1100 may be designed in a form of a centrifugal compressor or an axial compressor, and the centrifugal compressor is applied to a small gas turbine, whereas a multistage axial compressor is applied to a large gas turbine 1000 illustrated in FIG. 1 to compress a large amount of air. In the multistage axial compressor, the compressor blades 1130 rotate along with a rotation of rotor disks, compress the introduced air and deliver the compressed air to compressor vanes 1140 disposed at a following stage. The air is compressed gradually to a high pressure while passing through the compressor blades 1130 formed in a multistage manner.

A plurality of compressor vanes 1140 may be mounted in a compressor casing 1150 in such a way that the plurality of compressor vanes 1150 form each stage. The plurality of compressor vanes 1140 guide the compressed air flowing from compressor blades 1130 disposed at a preceding stage to compressor blades 1130 disposed at a following stage. For example, at least some of the plurality of compressor vanes 1140 may be rotatably mounted within a predetermined range, e.g., to adjust an inflow rate of air.

The compressor 1100 may be driven by a portion of the power output from the turbine 1300. To this end, a rotary shaft of the compressor 1100 may be directly connected to a rotary shaft of the turbine 1300. In the case of the large-scale gas turbine 1000, almost half of the power generated by the turbine 1300 may be consumed to drive the compressor 1100. Accordingly, an overall efficiency of the gas turbine 1000 can be enhanced by directly increasing the efficiency of the compressor The turbine 1300 includes a plurality of rotor disks 1310, a plurality of turbine blades radially arranged on each of the rotor disks 1310, and a plurality of turbine vanes. Each of the rotor disks 1310 has a substantially disk shape, and a plurality of grooves are formed in an outer periphery thereof. Each groove is formed to have a curved surface so that the turbine blades are inserted into the grooves, and the turbine vanes are mounted in a turbine casing. The turbine vanes are fixed so as not to rotate and guide the flow direction of the combustion gas passing through the turbine blades. The turbine blades generate rotational force while rotating by the combustion gas.

The combustor 1200 may mix the compressed air supplied from an outlet of the compressor 1100 with fuel for isobaric combustion to produce combustion gas with high energy. FIG. 2 illustrates an example of the combustor 1200 applied to the gas turbine 1000. The combustor 1200 may include a combustor casing 1210, a nozzle assembly 1220, a nozzle 1400, and a duct assembly 1250.

The combustor casing 1210 may have a substantially cylindrical shape to surround a plurality of nozzle assemblies 1220. The nozzle assemblies 1220 may be disposed along the annular combustor casing 1210 downstream of the compressor 1100. Each of the nozzle assemblies 1220 includes a plurality of nozzles 1400, and the fuel injected from the nozzles 1400 is mixed with air at an appropriate rate so that the mixture thereof is suitable for combustion.

The gas turbine 1000 may use gas fuel containing hydrogen. The fuel may be either hydrogen fuel alone or fuel containing hydrogen and natural gas.

Referring to FIG. 2, compressed air is supplied to the nozzles 1400 along an outer surface of the duct assembly 1250, which connects a section between the nozzle assemblies 1220 and the turbine 1300 so that high-temperature combustion gas flows to heat the duct assembly 1250, thereby properly cooling the heated duct assembly 1250.

The duct assembly 1250 may include a liner 1251, a transition piece 1252, and a flow sleeve 1253. The duct assembly 1250 has a double-wall structure in which the flow sleeve 1253 surrounds the liner 1251 and the transition piece 1252. The liner 1251 and the transition piece 1252 are cooled by the compressed air permeated into an annular space 1257 formed inside the flow sleeve 1253.

The liner 1251 is a tubular member connected to the nozzle assembly 1220 of the combustor 1200, and a combustion chamber 1240 is an internal space of the liner 1251. The liner 1251 has one longitudinal end coupled to the nozzle assembly 1220 and the other longitudinal end coupled to the transition piece 1252.

The transition piece 1252 is connected to an inlet of the turbine 1300 to guide high-temperature combustion gas to the turbine 1300. The transition piece 1252 has one longitudinal end coupled to the liner 1251 and the other longitudinal end coupled to the turbine 1300. The flow sleeve 1253 serves to protect the liner 1251 and the transition piece 1252 to prevent high-temperature heat from being directly released to the outside.

Figure 3:
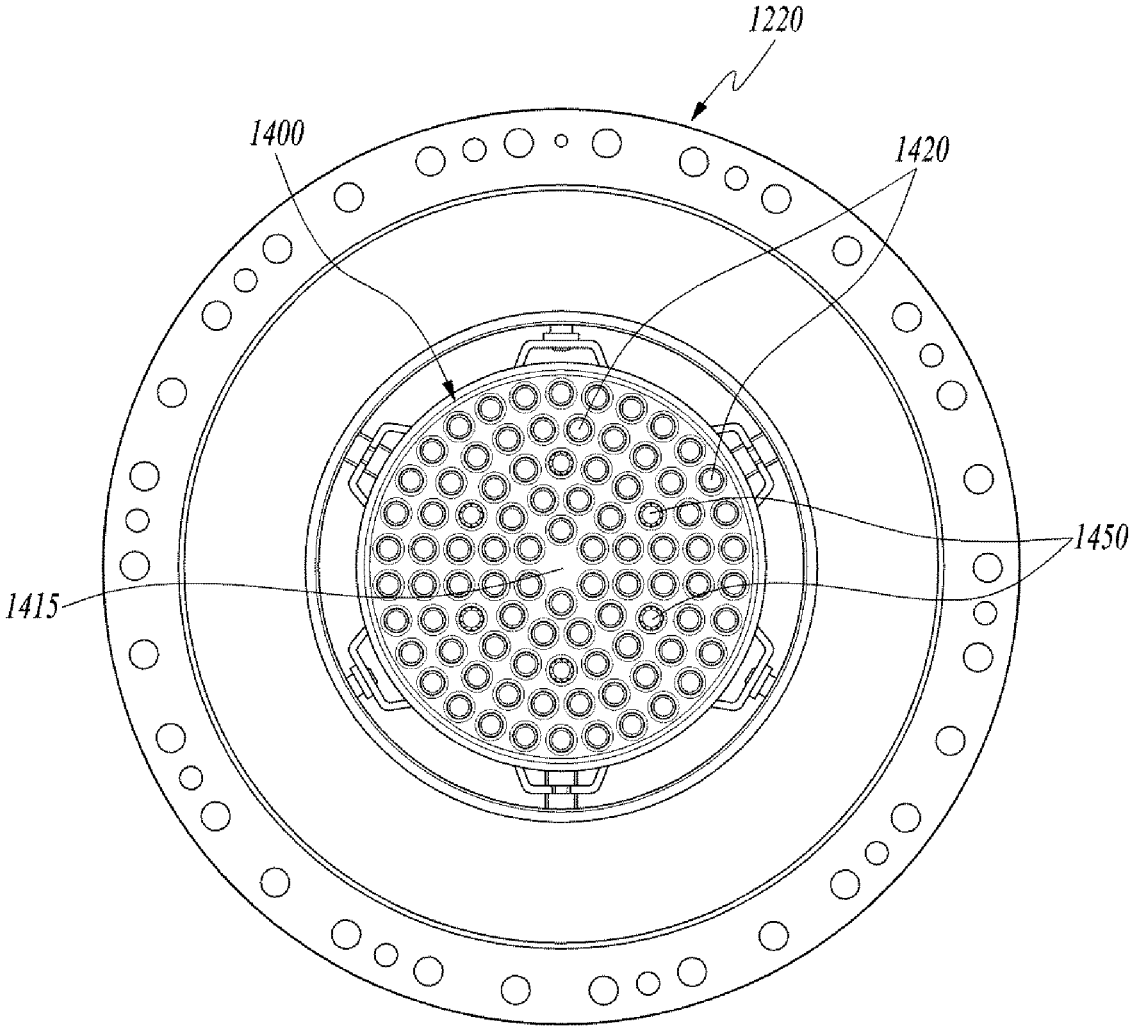
FIG. 3 is a front view illustrating one nozzle assembly according to an exemplary embodiment.
Figure 4:
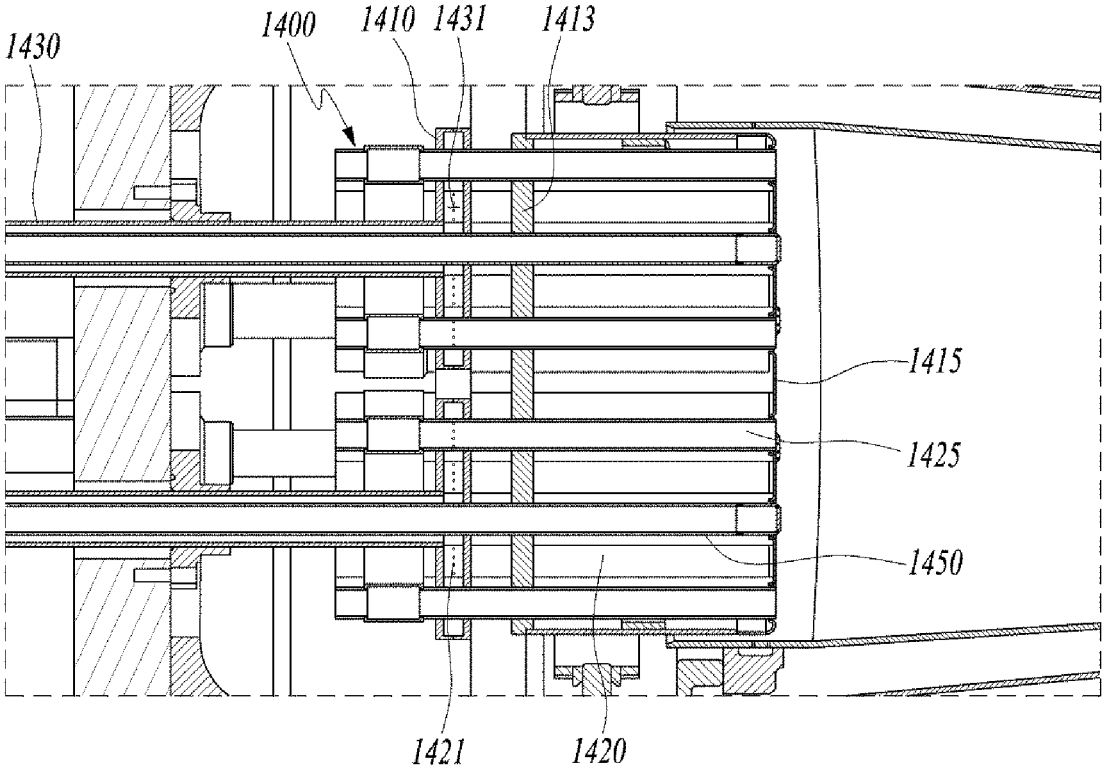
FIG. 4 is a longitudinal cross-sectional view of one nozzle according to an exemplary embodiment.
Figure 5:
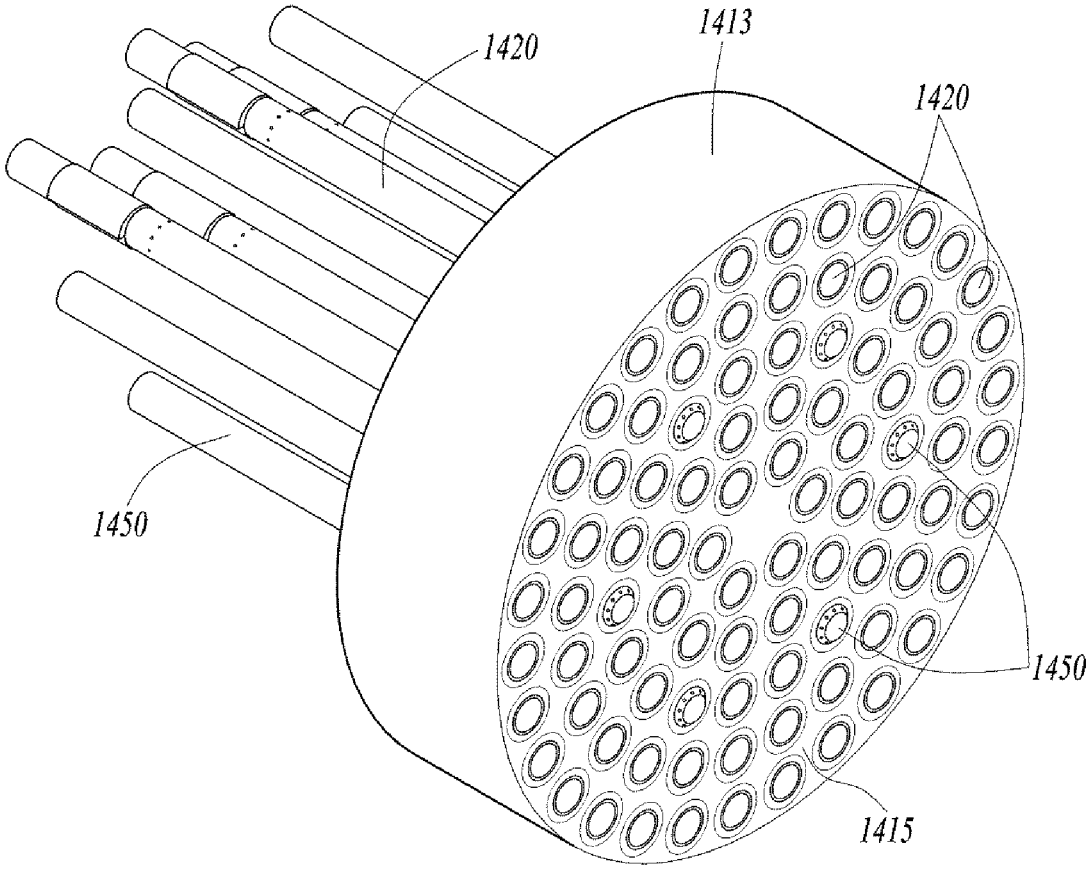
FIG. 5 is a perspective view illustrating a portion of the nozzle according to an exemplary embodiment.

FIG. 3 is a front view illustrating one nozzle assembly according to an exemplary embodiment. FIG. 4 is a longitudinal cross-sectional view of one nozzle according to an exemplary embodiment. FIG. 5 is a perspective view illustrating a portion of the nozzle according to an exemplary embodiment.

Referring to FIGS. 3 to 5, the nozzle 1400 may include a fuel supply duct 1410 which includes a plurality of injection tubes 1420 through which air and fuel flow and a fuel passage 1431 through which fuel flows and a plurality of fuel inlet holes 1421 formed radially through each injection tube 1420 to communicate with the fuel passage 1431 so that fuel can be introduced into the injection tube 1420.

The nozzle 1400 may further include a fuel supply pipe 1430 for supplying fuel to the fuel supply duct 1410. Here, the fuel may be gas containing hydrogen. Although it is illustrated in the drawing that the fuel supply duct 1410 is divided into six fuel supply ducts and the fuel supply pipe 1430 is connected to one side of each of the divided fuel supply ducts 1410, a plurality of fuel supply ducts 1410 may be connected to the fuel supply pipe 1430.

The fuel supply duct 1410 may include the injection tubes 1420 to form several small flames using hydrogen gas. The injection tubes 1420 may be spaced apart from each other in the fuel supply duct 1410 and formed parallel to each other.

A blocking plate 1415 is installed at ends of the injection tubes 1420 to form a fuel passage through which fuel flows. The blocking plate 1415 may block the space between each injection tube 1420 to prevent fuel leakage.

The first halves of the injection tubes 1420 may be mounted to and supported by a bracket 1413. The bracket 1413 may surround the first halves of the injection tubes 1420, and the injection tubes 1420 and a plurality of diffusion nozzle tubes 1450 may be mounted through the bracket 1413.

The fuel introduced into the fuel supply duct 1410 through the fuel supply pipe 1430 flows along the fuel passage 1431. The fuel passage 1431 provided with the injection tubes 1420 passing through the fuel passage 1431 surrounds the injection tubes 1420.

The fuel inlet holes 1421 for introducing fuel may be formed along a side surface of each of the injection tubes 1420. The fuel inlet holes 1421 may be spaced apart from the injection tube 1420 in a circumferential direction. Alternatively, the fuel inlet holes 1421 may be longitudinally spaced apart from the injection tube 1420. The injection tube 1420 may have an injection port 1425 formed to inject a mixture of air and fuel.

The fuel supply duct 1410 may be mounted to surround the plurality of fuel inlet holes 1421 formed in the plurality of injection tubes 1420. In other words, the plurality of injection tubes 1420 are mounted to pass through the fuel supply duct 1410, and the fuel supply duct 1410 may have a thin thickness to surround the plurality of fuel inlet holes 1421 in the longitudinal direction of the injection tubes 1420. The fuel supply duct 1410 may be in the form of a single circular disk that surrounds all the injection tubes 1420 and has the fuel passage 1431 therein, or may be formed in a fan shape to mount a predetermined number of injection tubes 1420. For example, six fan-shaped fuel supply ducts 1410 may be mounted in the form of a circular disk in overall contour.

Accordingly, the fuel introduced through the fuel supply pipe 1430 flows into the injection tubes 1420 through the fuel inlet holes 1421 while flowing to the fuel passage 1431 inside the fuel supply duct 1410, and is injected into the combustion chamber together with air. The air and fuel introduced into the injection tubes 1420 may be mixed and injected through the injection ports 1425 for combustion. Therefore, air and fuel can be mixed more uniformly to form a stable flame.

Figure 6:
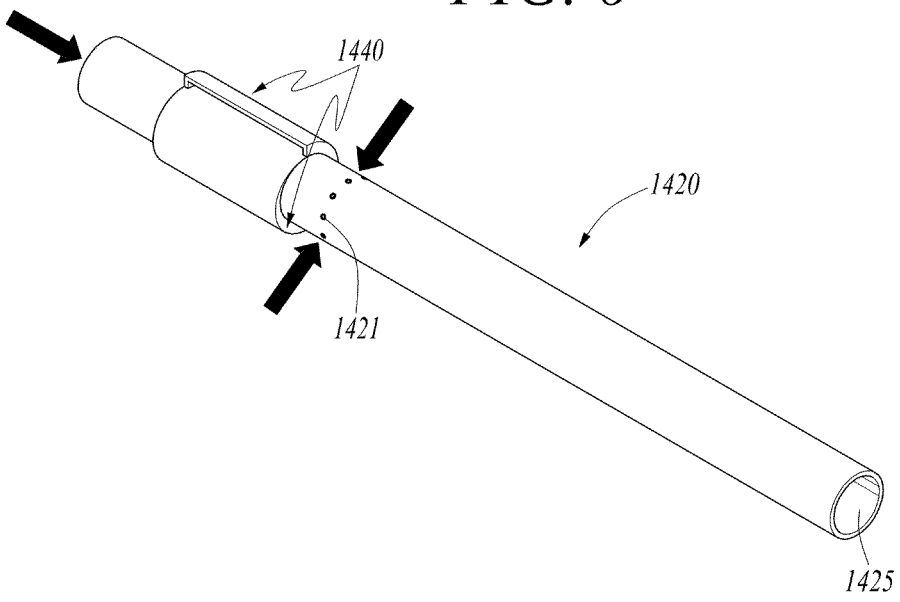
FIG. 6 is a perspective view illustrating one injection tube according to a first exemplary embodiment.
Figure 7:
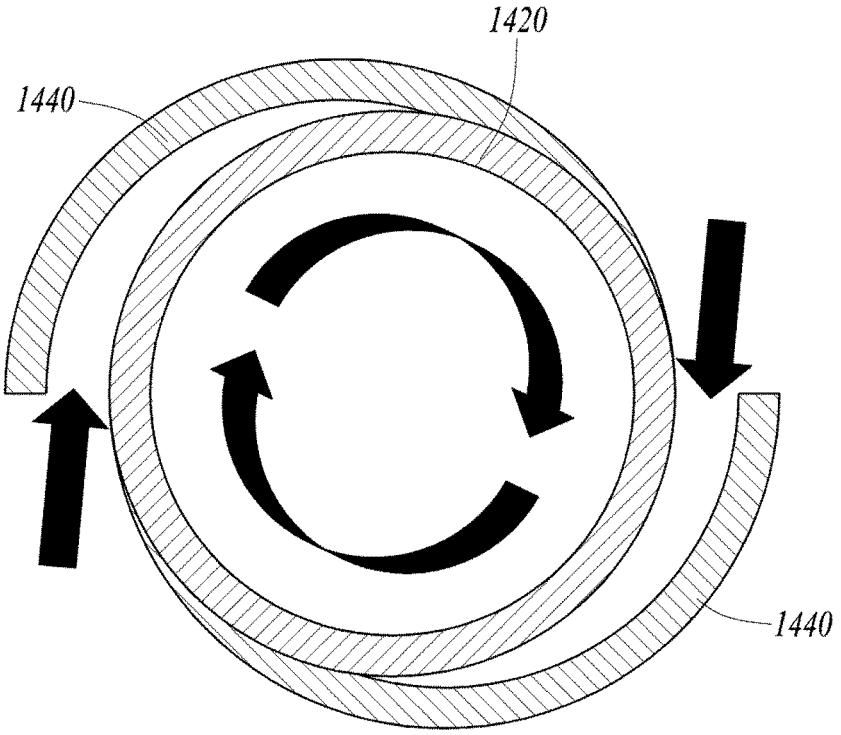
FIG. 7 is a cross-sectional view taken along a plane passing through a tube swirler in FIG. 6.
Figure 8:
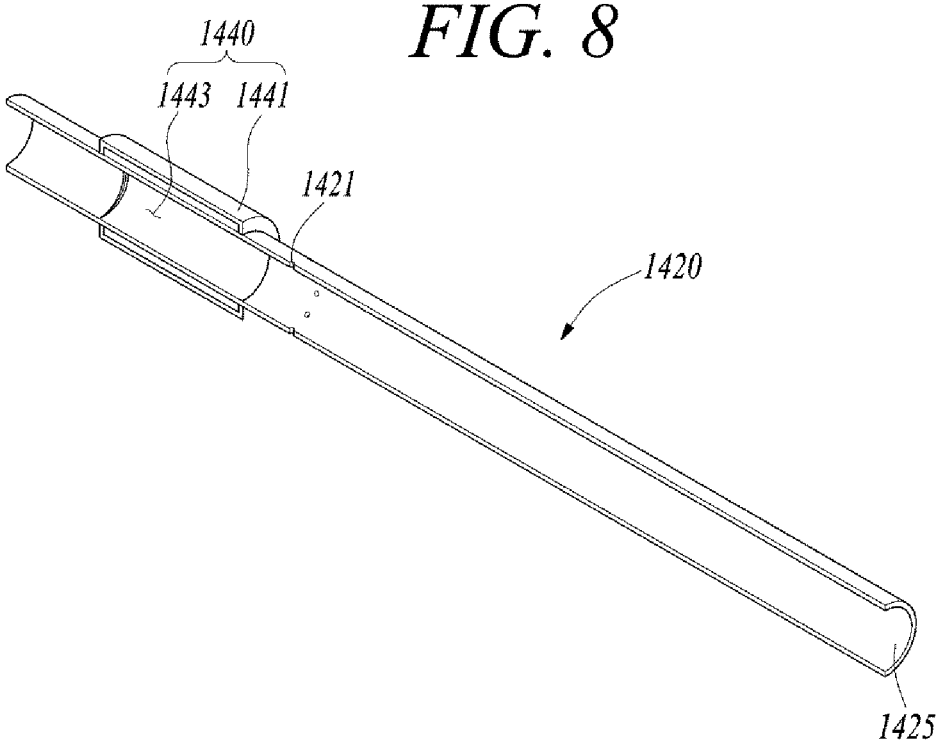
FIG. 8 is a longitudinal cross-sectional view of the injection tube in FIG. 6.
Figure 9:
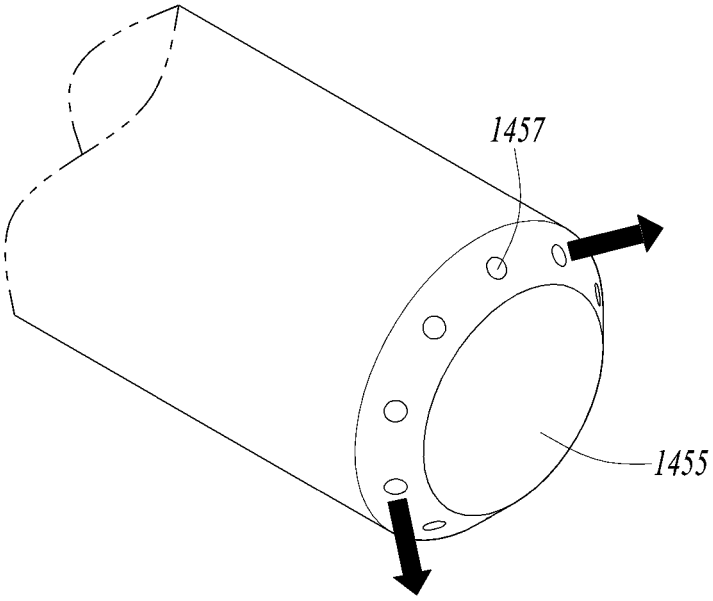
FIG. 9 is a partial perspective view illustrating one diffusion nozzle tube.

FIG. 6 is a perspective view illustrating one injection tube according to a first exemplary embodiment. FIG. 7 is a cross-sectional view taken along a plane passing through a tube swirler in FIG. 6. FIG. 8 is a longitudinal cross-sectional view of the injection tube in FIG. 6. FIG. 9 is a partial perspective view illustrating one diffusion nozzle tube.

Each of the injection tubes 1420 may include a plurality of swirlers formed on the side surface thereof to guide air from outside the injection tube to be introduced thereinto for swirling.

Referring to FIG. 6, the swirlers may be tube swirlers 1440 formed on a side surface of the injection tube 1420 to guide air introduced through the swirlers in the circumferential direction. Although two tube swirlers 1440 are illustrated to be formed in one injection tube 1420, two to four tube swirlers 1440 may be formed.

Referring to FIG. 8, each of the tube swirlers 1440 may include a swirl guide hole 1443 formed through the side surface of the injection tube 1420 at an angle of 80 to 180 degrees, and a swirl guide 1441 connected to the swirl guide hole 1443 so as to be coupled to one side of the swirl guide hole 1443 and gradually radially directed in the circumferential direction of the other side.

The swirl guide hole 1443 may include two swirl guide holes formed through the side surface of the injection tube 1420 at an angle close to 180 degrees, each having a rectangular shape. The swirl guide 1441 may have a curved shape having a slightly larger radius of curvature than the side surface of the injection tube 1420. One end of the swirl guide 1441 may be integrally connected to one end of the swirl guide hole 1443, and the other end may be formed to be spaced apart from the other end of the swirl guide hole 1443 by a predetermined distance in a radial direction. The swirl guide 1441 may have both side edges connected integrally to both ends of the swirl guide hole 1443. Thus, as illustrated in FIG. 7, air outside the injection tube 1420 may be introduced into the inlets of the pair of swirl guides 1441 and then flow into the injection tube 1420 through the swirl guide holes 1443 while swirling.

For example, if four tube swirlers 1440 are formed in one injection tube 1420, four swirl guide holes 1443 and four swirl guides 1441 may be formed at an angle of less than 90 degrees.

The fuel inlet holes 1421 may be formed radially through the side surface of the injection tube 1420 to communicate with the fuel passage, so that fuel is introduced into the injection tube 1420 through the fuel inlet holes 1421. As illustrated in FIGS. 6 and 8, eight fuel inlet holes 1421 may be formed through the side surface of the injection tube 1420, each having a circular shape. The fuel inlet holes 1421 may be spaced apart from each other by a predetermined distance, and may be formed to face a center of the injection tube 1420.

In the injection tube 1420, the tube swirler 1440 is disposed between one end of the injection tube 1420 for introducing air and the fuel inlet holes 1421. Therefore, the primary air flowing into one end of the injection tube 1420 and the secondary air flowing into and swirling through the tube swirlers 1440 may be properly mixed in the injection tube 1420 with the gas fuel introduced through the fuel inlet holes 1421.

Referring to FIGS. 4, 5, and 9, the fuel supply duct 1410 may include a plurality of diffusion nozzle tubes 1450 arranged between the injection tubes 1420. The diffusion nozzle tube 1450 may have an end cap 1455 formed at an end thereof, and the end cap 1455 may have a plurality of diffusion injection holes 1457 formed therein.

FIG. 5 illustrates an example in which a plurality (e.g., 84) of injection tubes 1420 and a plurality (e.g., 6) of diffusion nozzle tubes 1450 are arranged. As illustrated in FIG. 9, the end cap 1455 may be in the form of a circular disk having a predetermined thickness and may be connected integrally to the diffusion nozzle tube 1450 to block one end thereof. The end cap 1455 may have an edge chamfered to be inclined. The diffusion injection holes 1457 may be formed perpendicular to the chamfered edge of the end cap 1455.

The diffusion nozzle tube 1450 may have the diffusion injection holes 1457 formed therethrough and inclined at a predetermined angle with respect to the center of the diffusion nozzle tube 1450. In other words, the diffusion injection holes 1457 in the diffusion nozzle tube 1450 may be formed through the edge of the end cap 1455 to be inclined at a predetermined angle in a tangential direction tangential.

Accordingly, the diffusion nozzle tube 1450 may include the diffusion injection holes 1457 inclined with respect to the longitudinal direction to generate a swirl flow of air introduced into the diffusion nozzle tube 1450 so that it can be well mixed with the air flowing into the injection tube 1420 for combustion. For example, in a section of ignition and starting, the high air-to-fuel equivalence ratio increases the likelihood of backfire. However, the diffusion nozzle tubes 1450 arranged between the injection tubes 1420 can prevent backfire.

Figure 10:
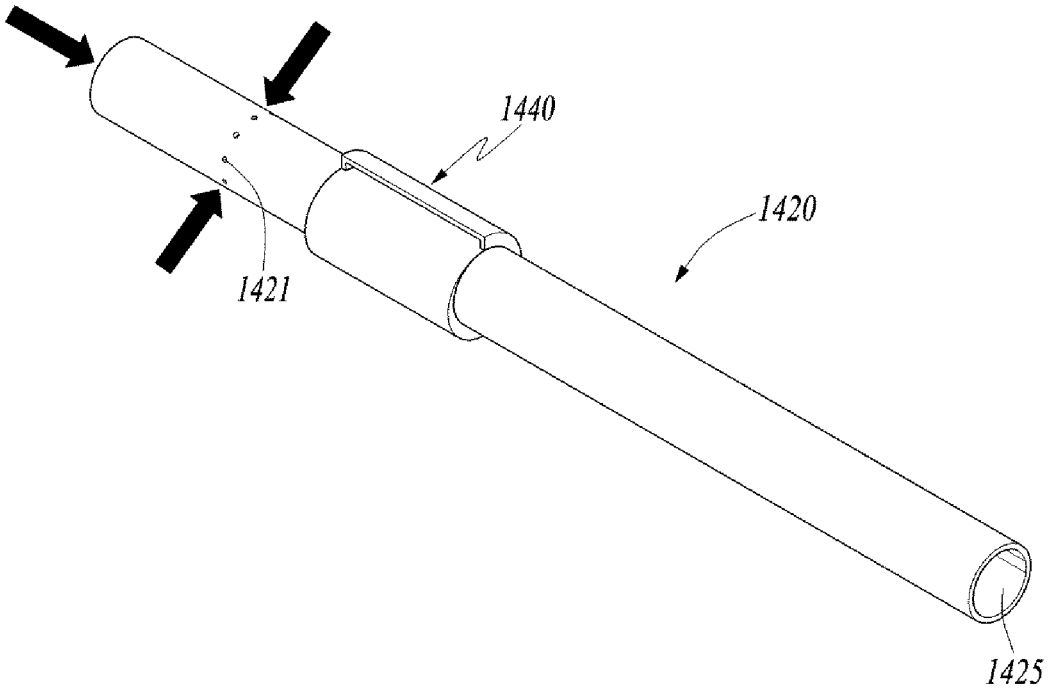
FIG. 10 is a perspective view illustrating one injection tube according to a second exemplary embodiment.

FIG. 10 is a perspective view illustrating one injection tube according to a second exemplary embodiment.

Referring to FIG. 10, the injection tube 1420 has a plurality of fuel inlet holes 1421 arranged between one end of the injection tube 1420 for introducing air and a plurality of tube swirlers 1440.

In the injection tube 1420 of FIG. 6, the fuel inlet holes 1421 are arranged downstream of the tube swirlers 1440 through which secondary air is introduced based on the flow direction of air. On the other hand, in the injection tube 1420 of FIG. 10, the tube swirlers 1440 are disposed downstream of the fuel inlet holes 1421. Therefore, the primary air introduced into one end of the injection tube 1420 may be first mixed with the gas fuel introduced through the fuel inlet holes 1421, and then remixed with the secondary air introduced through the tube swirlers 1440.

Figure 11:
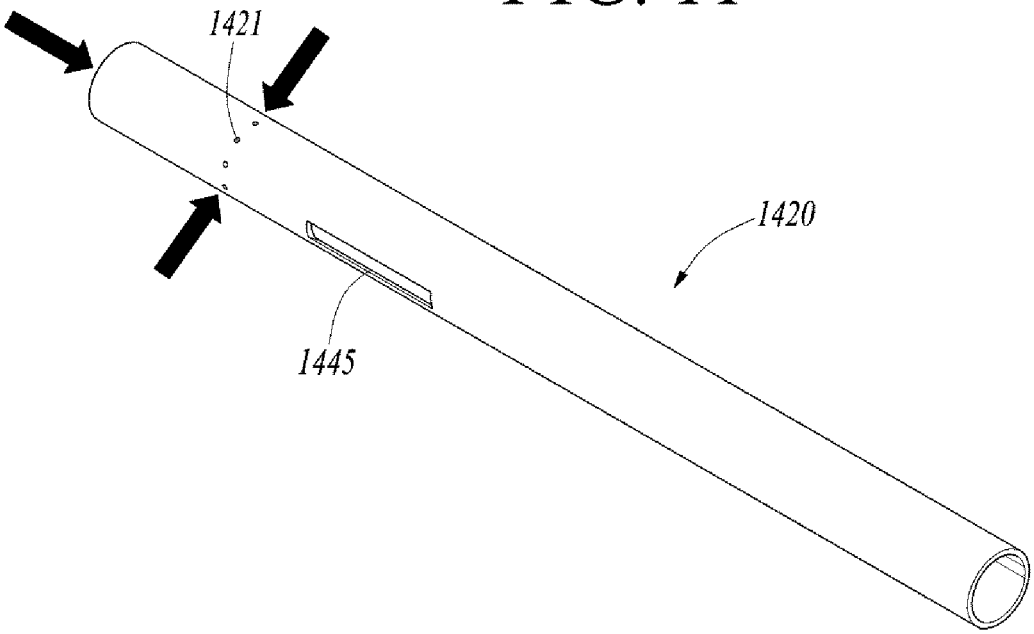
FIG. 11 is a perspective view illustrating one injection tube according to a third exemplary embodiment.
Figure 12:
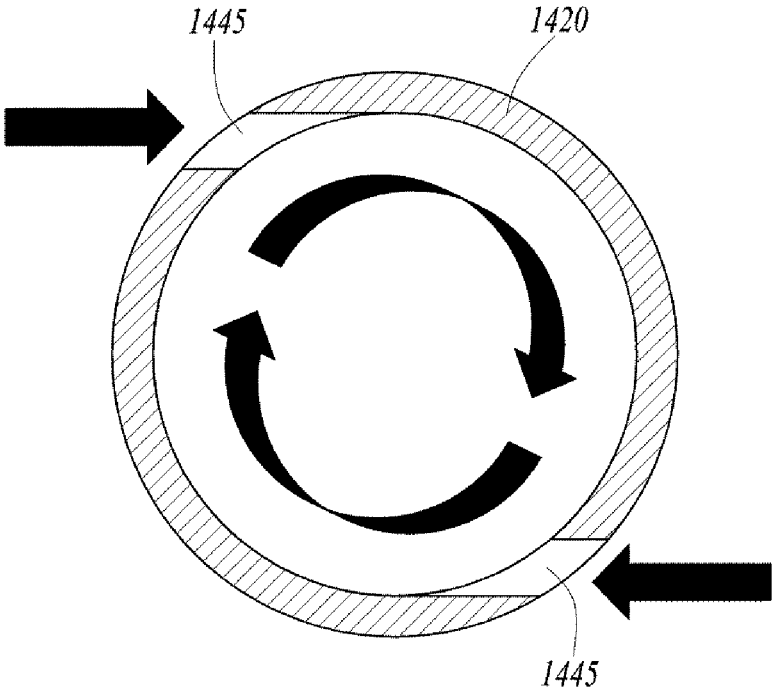
FIG. 12 is a cross-sectional view taken along a plane passing through a hole swirler in FIG. 11.

FIG. 11 is a perspective view illustrating one injection tube according to a third exemplary embodiment. FIG. 12 is a cross-sectional view taken along a plane passing through a hole swirler in FIG. 11.

Referring to FIGS. 11 and 12, the injection tube 1420 may include a hole swirler 1445 formed through the side surface of the injection tube 1420 to be in contact with the inner peripheral surface and configured to guide air introduced through the swirler in the circumferential direction.

Although the hole swirler 1445 is illustrated to have two hole swirlers 1445, three or four hole swirlers may be formed. Each of the hole swirlers 1445 may have a rectangular shape and may be elongated in the longitudinal direction when viewed from the outside of the injection tube 1420. The hole swirler 1445 may be formed through the injection tube 1420 to contact the inner peripheral surface so that the flow of air through the hole swirler 1445 is swirled along the inner peripheral surface of the injection tube 1420. The secondary air introduced into the injection tube 1420 through the hole swirlers 1445 may be mixed with primary air and fuel while swirling in one direction in the injection tube 1420.

As illustrated in FIG. 11, the injection tube 1420 may have a plurality of fuel inlet holes 1421 formed radially on the side surface of the injection tube 1420 to communicate with the fuel passage and allow fuel to flow into the injection tube 1420 therethrough. The fuel inlet holes 1421 may be arranged between one end of the injection tube 1420 for introducing air and the hole swirlers 1445.

The arrangement of the fuel inlet holes 1421 and the hole swirlers 1445 in the injection tube 1420 of the third exemplary embodiment is the same as in the injection tube 1420 of the first exemplary embodiment, except for the shape of each hole swirler 1445.

As described above, according to the combustor nozzle, the combustor, and the gas turbine including the same, because the swirlers and the fuel inlet holes are formed in each injection tube, it is possible to minimize backfire and improve fuel-air mixing characteristics to reduce $NO_x$ emission and increase flame stability.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A nozzle for a combustor configured to burn fuel containing hydrogen, comprising:

a fuel supply duct comprising a plurality of injection tubes through which air and the fuel flow and a fuel passage through which the fuel flows;

a plurality of swirlers formed on a side surface of each of the plurality of injection tubes to guide the air outside an injection tube of the plurality of injection tubes to be introduced thereinto for swirling; and a plurality of fuel inlet holes formed radially through the injection tube to communicate with the fuel passage and allow the fuel to flow through the fuel passage to the injection tube, wherein the plurality of swirlers are tube swirlers formed on the side surface of the injection tube to guide the air introduced through the plurality of swirlers in a circumferential direction, wherein each of the plurality of swirlers comprises a swirl guide hole and a swirl guide, the swirl guide hole being formed on the side surface of the injection tube, the swirl guide having one circumferential end and other circumferential end, wherein the one circumferential end of the swirl guide is connected to one side of the swirl guide hole and the other circumferential end of the swirl guide forms an air inlet between the side surface of the injection tube and swirl guide, and the swirl guide has a curved shape from the one circumferential end to the other circumferential end such that the swirl guide becomes gradually farther from a center of the injection tube toward the other circumferential end, and wherein the swirl guide hole is formed through the side surface of the injection tube at an angle of 80 to 180 degrees in the circumferential direction to generate swirl of the air entering the injection tube.

2. The nozzle according to claim 1, wherein the tube swirler is disposed between one end of the injection tube for introducing the air and the fuel inlet holes.

3. The nozzle according to claim 1, wherein the fuel inlet holes are arranged between one end of the injection tube for introducing the air and the tube swirlers.

4. The nozzle according to claim 2, wherein the fuel supply duct further comprises a plurality of diffusion nozzle tubes arranged between the plurality of injection tubes, each of the diffusion nozzle tubes having an end cap formed at an end, the end cap having a plurality of diffusion injection holes formed therein.

5. The nozzle according to claim 4, wherein the plurality of diffusion injection holes of the each of the diffusion nozzle tubes are exclusively formed on an chamfered edge, the plurality of diffusion injection holes being formed in an inclined direction with respect to a longitudinal direction of the injection tube.

6. The nozzle according to claim 5, wherein the plurality of diffusion injection holes are formed perpendicular to the chamfered edge of the end cap.

7. The nozzle according to claim 1, wherein the plurality of swirlers are hole swirlers formed through the side surface of the injection tube to contact with an inner peripheral surface and configured to guide the air introduced through the plurality of swirlers in a circumferential direction.

8. The nozzle according to claim 7, wherein the plurality of fuel inlet holes are formed radially through the side surface of the injection tube to communicate with the fuel passage and allow the fuel to flow through the fuel passage to the injection tube, and the plurality of fuel inlet holes are arranged between one end of the injection tube for introducing the air and the hole swirlers.

9. The nozzle according to claim 1, wherein the curved shape of the swirl guide has a larger curvature radius than the side surface of the injection tube.

10. The nozzle according to claim 1, wherein both longitudinal edges of the swirl guide in a longitudinal direction of the injection tube are integrally connected to both longitudinal ends of the swirl guide hole, respectively.

11. A combustor comprising:

a nozzle assembly having a plurality of nozzles configured to inject fuel and air; and a duct assembly coupled to one side of the nozzle assembly to burn a mixture of the fuel and the air and transmit combustion gas to a turbine, wherein each of the plurality of nozzles comprises:

a fuel supply duct comprising a plurality of injection tubes through which the air and the fuel flow and a fuel passage through which the fuel flows;

a plurality of swirlers formed on a side surface of each of the plurality of injection tubes to guide the air outside an injection tube of the plurality of injection tubes to be introduced thereinto for swirling; and a plurality of fuel inlet holes formed radially through the injection tube to communicate with the fuel passage and allow the fuel to flow through the fuel passage to the injection tube, wherein the plurality of swirlers are tube swirlers formed on the side surface of the injection tube to guide the air introduced through the plurality of swirlers in a circumferential direction, wherein each of the plurality of swirlers comprises a swirl guide hole and a swirl guide, the swirl guide hole being formed on the side surface of the injection tube, the swirl guide having one circumferential end and other circumferential end, wherein the one circumferential end of the swirl guide is connected to one side of the swirl guide hole and the other circumferential end of the swirl guide forms an air inlet between the side surface of the injection tube and swirl guide, and the swirl guide has a curved shape from the one circumferential end to the other circumferential end such that the swirl guide becomes gradually farther from a center of the injection tube toward the other circumferential end, and wherein the swirl guide hole is formed through the side surface of the injection tube at an angle of 80 to 180 degrees in the circumferential direction to generate swirl of the air entering the injection tube.

12. The combustor according to claim 11, wherein the tube swirler is disposed between one end of the injection tube for introducing the air and the fuel inlet holes.

13. The combustor according to claim 12, wherein the fuel inlet holes are arranged between one end of the injection tube for introducing the air and the tube swirlers.

14. The combustor according to claim 12, wherein the fuel supply duct further comprises a plurality of diffusion nozzle tubes arranged between the plurality of injection tubes, each of the diffusion nozzle tubes having an end cap formed at an end, the end cap having a plurality of diffusion injection holes formed therein.

15. The combustor according to claim 14, wherein the plurality of diffusion injection holes of the each of the diffusion nozzle tubes are exclusively formed on an chamfered edge, the plurality of diffusion injection holes being formed in an inclined direction with respect to a longitudinal direction of the injection tube.

16. The combustor according to claim 11, wherein the plurality of swirlers are hole swirlers formed through the side surface of the injection tube to contact with an inner peripheral surface and configured to guide the air introduced through the plurality of swirlers in a circumferential direction.

17. The combustor according to claim 16, wherein the plurality of fuel inlet holes are formed radially through the side surface of the injection tube to communicate with the fuel passage and allow the fuel to flow through the fuel passage to the injection tube, and the plurality of fuel inlet holes are arranged between one end of the injection tube for introducing the air and the hole swirlers.

18. A gas turbine comprising:

a compressor configured to compress air introduced from an outside;

a combustor configured to mix fuel with the air compressed by the compressor and combust a mixture of the fuel and the air to produce combustion gas; and a turbine having a plurality of turbine blades rotated by the combustion gas produced by the combustor, wherein the combustor comprises a nozzle assembly having a plurality of nozzles configured to inject fuel and air, and a duct assembly coupled to one side of the nozzle assembly to burn the mixture of the fuel and the air and transmit the combustion gas to the turbine, wherein each of the plurality of nozzles comprises:

a fuel supply duct comprising a plurality of injection tubes through which the air and the fuel flow and a fuel passage through which the fuel flows;

a plurality of swirlers formed on a side surface of each of the plurality of injection tubes to guide the air outside an injection tube of the plurality of injection tubes to be introduced thereinto for swirling; and a plurality of fuel inlet holes formed radially through the injection tube to communicate with the fuel passage and allow the fuel to flow through the fuel passage to the injection tube, wherein the plurality of swirlers are tube swirlers formed on the side surface of the injection tube to guide the air introduced through the plurality of swirlers in a circumferential direction, wherein each of the plurality of swirlers comprises a swirl guide hole and a swirl guide, the swirl guide hole being formed on the side surface of the injection tube, the swirl guide having one circumferential end and other circumferential end, wherein the one circumferential end of the swirl guide is connected to one side of the swirl guide hole and the other circumferential end of the swirl guide forms an air inlet between the side surface of the injection tube and swirl guide, and the swirl guide has a curved shape from the one circumferential end to the other circumferential end such that the swirl guide becomes gradually farther from a center of the injection tube toward the other circumferential end, and wherein the swirl guide hole is formed through the side surface of the injection tube at an angle of 80 to 180 degrees in the circumferential direction to generate swirl of the air entering the injection tube.

* * * * *